US010780572B2

(12) United States Patent
Paradis

(10) Patent No.: US 10,780,572 B2
(45) Date of Patent: Sep. 22, 2020

(54) HOCKEY STICK TOOLBOX

(71) Applicant: Daniel Paradis, Saint-André (CA)

(72) Inventor: Daniel Paradis, Saint-André (CA)

( * ) Notice: Subject to any disclaimer, the term of this patent is extended or adjusted under 35 U.S.C. 154(b) by 90 days.

(21) Appl. No.: 16/350,572

(22) Filed: Dec. 6, 2018

(65) Prior Publication Data

US 2020/0180139 A1 Jun. 11, 2020

(51) Int. Cl.
*B25H 3/02* (2006.01)
*A63B 71/00* (2006.01)
*A63B 102/24* (2015.01)

(52) U.S. Cl.
CPC ..... *B25H 3/02* (2013.01); *A63B 71/00* (2013.01); *A63B 2102/24* (2015.10); *A63B 2225/30* (2013.01)

(58) Field of Classification Search
USPC ..... 206/315.1, 579, 582
See application file for complete search history.

(56) References Cited

U.S. PATENT DOCUMENTS 3,587,412 A * 6/1971 Thomas et al. ..... B65D 85/672 493/59
5,167,170 A * 12/1992 Croteau ..... A63C 3/10 206/315.1
5,607,154 A 3/1997 Meumann et al.
5,702,140 A * 12/1997 Radja ..... A63B 71/0045 294/146
5,758,767 A * 6/1998 Hincher ..... A63B 71/0045 206/315.1
7,104,402 B2 * 9/2006 Whalen ..... A45C 11/00 206/315.11
7,108,618 B2 9/2006 Frischmon et al.
8,403,134 B1 * 3/2013 Kantgias ..... A63B 71/0036 206/315.1
8,586,177 B2 11/2013 Wilbur et al.
8,960,426 B2 * 2/2015 Kelly ..... A63B 71/0036 206/315.1
8,967,375 B1 * 3/2015 Nitkin ..... A63C 11/025 206/315.2
2007/0084811 A1 * 4/2007 Dolson ..... A47B 81/005 211/85.7
2008/0252029 A1 * 10/2008 Walcott ..... A63B 71/0045 280/47.131
2010/0012257 A1 * 1/2010 Wilbur ..... B63B 71/00 156/98
2010/0273388 A1 * 10/2010 Carlson ..... A63H 33/04 446/4

(Continued)

FOREIGN PATENT DOCUMENTS

CA 2096304 11/1994
CA 2847653 10/2014
WO WO2018/112624 6/2018

*Primary Examiner* — Jacob K Ackun
(74) *Attorney, Agent, or Firm* — Mario Theriault

(57) ABSTRACT

This hockey stick toolbox comprises a casing, an assortment of tape; a pair of scissors; a handsaw and a miter box nested in that casing. The casing has spaced-apart notches for retaining a hockey stick steady in the miter box. The handsaw, the miter box, the assortment of tape and the scissors are particularly advantageous for trimming and customizing a new hockey stick on the-spur-of-the-moment by a parent of a novice player for example.

5 Claims, 3 Drawing Sheets

(56) References Cited

U.S. PATENT DOCUMENTS

| | | | | |
|---|---|---|---|---|
| 2011/0100529 | A1* | 5/2011 | Bourne | B29C 73/04 156/94 |
| 2011/0119868 | A1* | 5/2011 | LaLonde | B25G 1/102 16/421 |
| 2012/0261043 | A1* | 10/2012 | Yanoff | A63B 60/58 150/154 |
| 2015/0126309 | A1* | 5/2015 | Steele | A63B 60/16 473/560 |
| 2015/0196144 | A1* | 7/2015 | Mathew | A47G 1/0605 206/575 |

* cited by examiner

HOCKEY STICK TOOLBOX

The present application claims the benefit of U.S. Provisional Application No. 62/708,332, filed Dec. 6, 2017.

FIELD OF THE INVENTION

This invention pertains to accessories for customizing a hockey stick according to preferences of a player.

BACKGROUND OF THE INVENTION

In order to better understand the nature of the present hockey stick toolbox, one has to remember or imagine oneself being at a hockey tournament with a child playing in semi-final against the strongest team in the league. It is the first period of the game and your child's team is in the lead. Every kid plays good and hard. The pressure is high amongst players, coaches and parents. All of a sudden, your child breaks his/her hockey stick and has no spare.

As a parent, you are responsible to quickly get a new hockey stick. Your child wants to go back on the ice and play the last period, at least. However, the sport store is a few miles away and traffic in town is congested. Your child is in the car with you, dressed in full hockey gear, with the skates off, and telling you what you need to buy. When the new hockey stick is found, there is no one at the store to cut the handle to the proper length. Hockey sticks must be trimmed exactly to suit the arm's length, the height and age of the player. The blade must be wrapped very precisely, in a scrim-like grip tape first, a covering tape and waxed between the layers and over the tapes. Some players like their hockey stick to be taped in white, others prefer black tape, depending upon the stick of their hockey star for example. You finally return to the arena with a new hockey stick and an assortment of wax and tape, hoping to find another parent who has a handsaw that you can borrow. However, you cannot find a handsaw. Your child's team loses the game. Your child is upset. The entire team is blaming you for their loss.

Because the above scenario is too common in novice and junior hockey, it is believed that there is a market need for a hockey stick accessory kit or a furnished toolbox for quickly customizing a hockey stick.

A search in the prior art has failed to offer any solution for such improvised customizing of a hockey stick. The following documents are cited for reference purposes:

U.S. Pat. No. 5,607,154 issued to R. E. Meumann et al., on Mar. 4, 1997;

U.S. Pat. No. 7,108,618 issued to T. J. Frischmon et al., on Sep. 19, 2006;

U.S. Pat. No. 8,586,177 issued to W. S. Wilbur et al., on Nov. 19, 2013.

These documents disclose respectively, a sleeve to join the broken ends of a hockey stick; a square plug to mend a hollow handle, and a mesh-and-adhesive-type sleeve to repair a broken handle. In all three cases, the ends of a broken stick must be trimmed and prepared in some way to receive the fixation. Such a repair can hardly be done impromptu by parents of a player. Therefore, it is believed that there is a need for a hockey stick accessory kit for quickly customizing a new hockey stick and let a player get back to the ice in a relatively short time.

SUMMARY OF THE INVENTION

The present hockey stick toolbox has been design for sale in the hockey stick section of a sport store. The toolbox contains all that one needs to trim a hockey stick to length and to tape and wax the blade to satisfy popular blade covering practices.

In a first aspect of the present invention, there is provided a hockey stick toolbox comprising a casing, and an assortment of tape and a pair of scissors, nested inside that casing. This toolbox is useful for preparing a new hockey stick that does not require cutting, for a junior player for example.

In another aspect of the present invention, there is provided a hockey stick toolbox comprising a casing, an assortment of tape; a pair of scissors; a handsaw and a miter box nested in that casing. The casing has spaced-apart notches for retaining a hockey stick steady in the miter box. The handsaw and miter box are particularly advantageous for trimming and customizing a new hockey stick for a novice player for example.

In a further aspect of the present invention, each of the aforesaid notches has a V-shape. Each of the aforesaid notches has an inclined side relative to a plan of the casing, for supporting a handle of the hockey stick such that a cross-section of the handle forms an apex pointing upward. With the hockey stick handle in this position, a handsaw has immediate grab on the handle to initiate a cut.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A preferred embodiment of the hockey stick toolbox according to the present invention is described with the aid of the accompanying drawings, in which like numerals denote like parts throughout the several views.

DETAILED DESCRIPTION OF THE PREFERRED EMBODIMENT

The preferred embodiment of the hockey stick toolbox according to the present invention is described herein below with reference to the attached drawings. The drawings have no dimension shown. The proportion of some features may have been emphasized for convenience. Some features might not be shown on all views. The drawings have been prepared in this manner to facilitate the understanding of the invention. It is to be understood that the drawings should not be scaled.

Many components of this toolbox were not illustrated to facilitate the understanding of the basic concept of the design. The components that were not illustrated are those for which the nature, mountings and functions would be obvious to the person skilled in the art of plastic boxes and cases.

Figure 1:
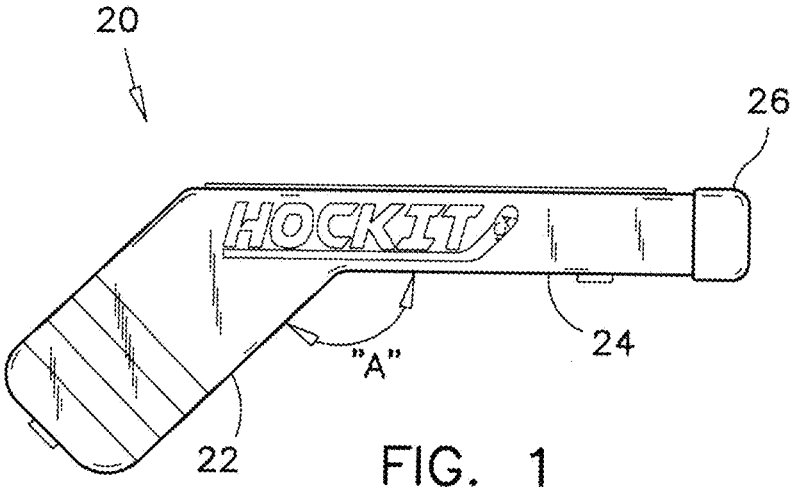
FIG. 1 is a plan view of the hockey stick toolbox according to a preferred embodiment of the present invention.

Referring to FIG. 1 the preferred hockey stick toolbox 20 is comprised of a casing made of wide portion 22 and a narrow portion 24. Both portions 22, 24 are connected together to give the toolbox 20 a general appearance of a hockey stick, with the wider portion 22 representing the blade of a hockey stick and the narrow portion 24 representing the handle of a hockey stick. The angle "A" between the longitudinal axes of both portions 22, 24 is also similar to the angle between the blade and the handle of a standard hockey stick.

A knob 26 at the end of the narrow portion 24 represents a ball of tape on the end of a hockey stick. This knob 26 is in fact, a hinged cap covering the end of a miter box inside the narrow portion 24, as will be described further herein.

Both portions 22, 24 are preferably made of plastic, preferably transparent or semi-transparent plastic. However, opaque plastic is also acceptable.

Figure 2:
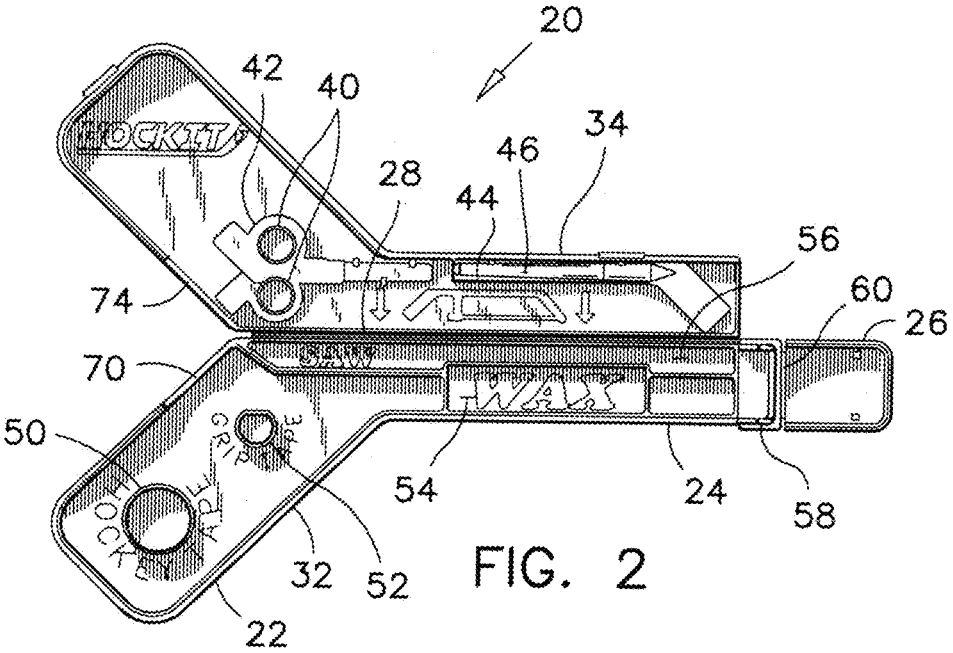
FIG. 2 is another plan view of the hockey stick toolbox, with the cover open.
Figure 3:
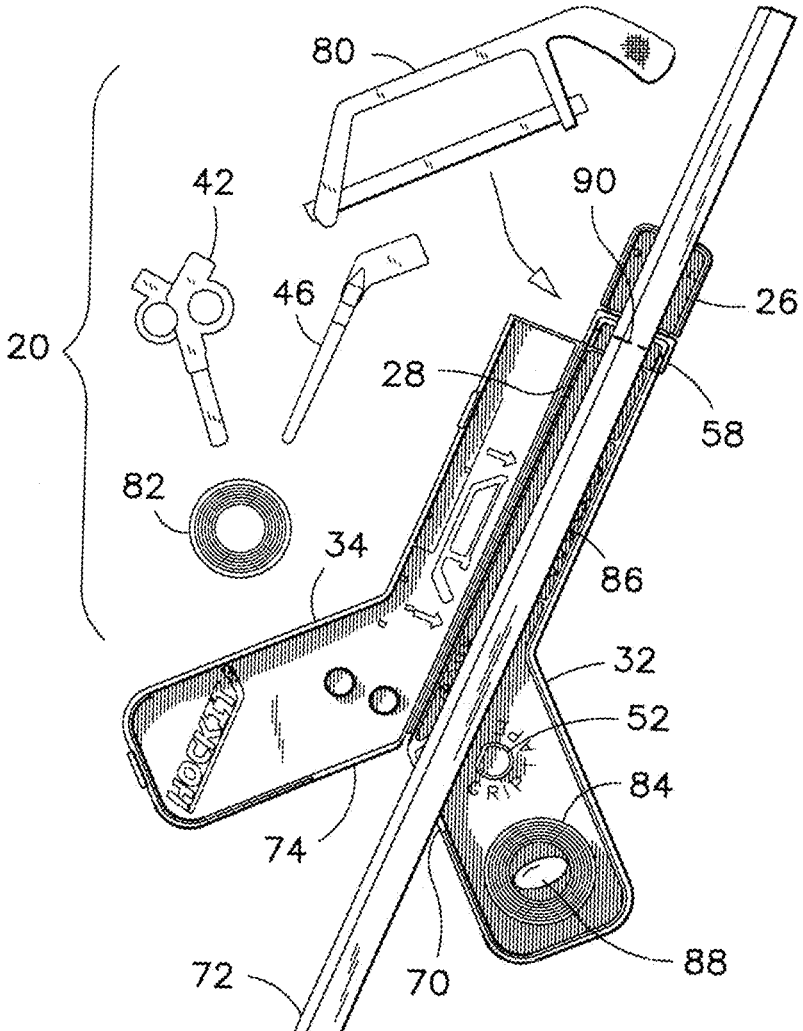
FIG. 3 is a yet another open plan view of the hockey stick toolbox with a hockey stick positioned in the miter box, ready to be sawed to proper length.

Referring now to FIG. 2, the toolbox 20 is made of two halves joined by a hinge 28. The bottom half 32 is preferably deeper than the top half 34. Both halves 32, 34 comprises bosses and compartments for nesting tools and accessory for customizing a hockey stick.

The top half 34 has two cylindrical bosses 40 therein to retain a pair of scissors 42, and a region 44 with clips to retain a marker 46 thereto. The bottom half 32 has two cylindrical bosses 50, 52 therein to retain one or more rolls of hockey tape and a roll of grip tape. A rectangular compartment 54 is provided for stowing blocks of hockey tape wax. A second elongated compartment 56 has dimensions to enclose a small handsaw therein. The bottom half 32 of the right end of the narrow portion 24 has a miter box 58 formed thereon or nested therein. The cap 26 is attached to the miter box by a second hinge 60.

Figure 4:
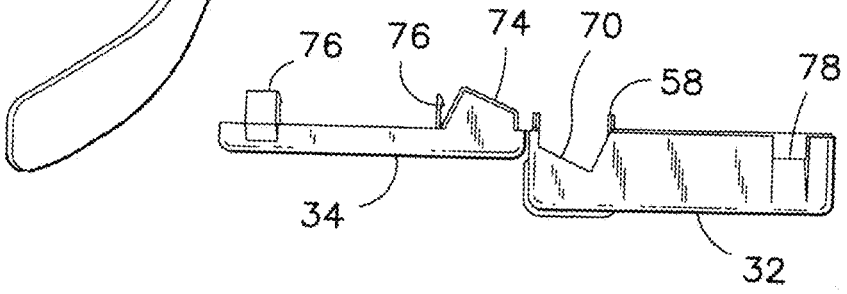
FIG. 4 is an end view of the casing of the preferred hockey stick toolbox.
Figure 5:
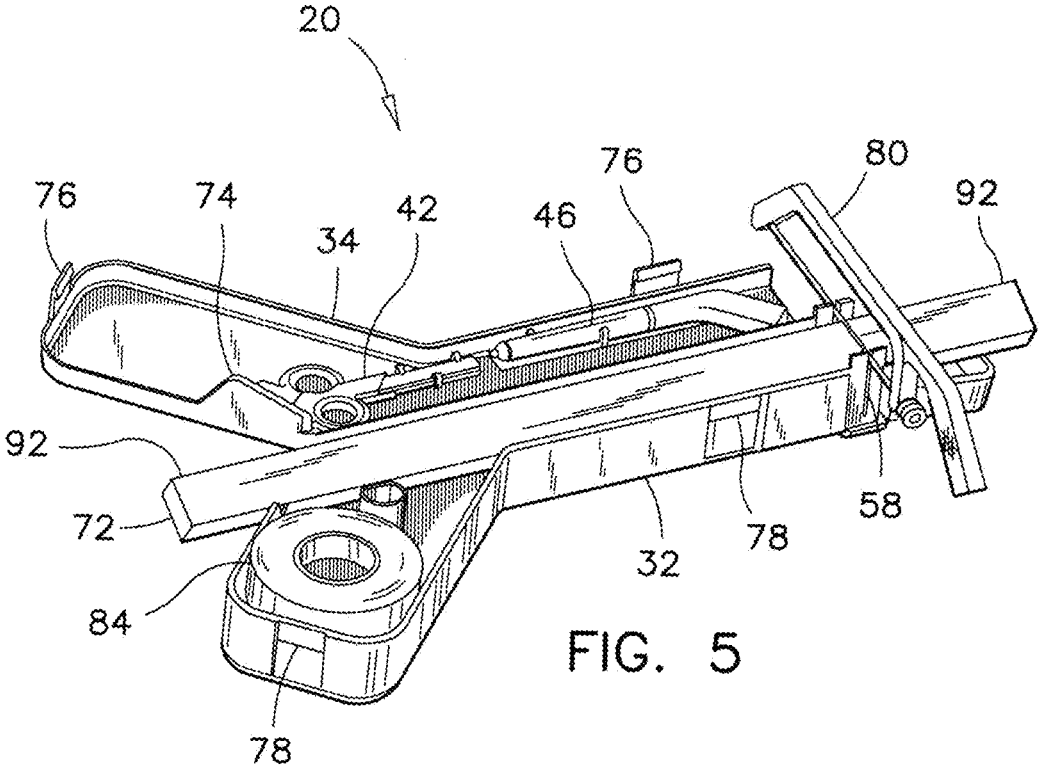
FIG. 5 is a perspective plan, front side and left end view of the preferred hockey tool box.
Figure 6:
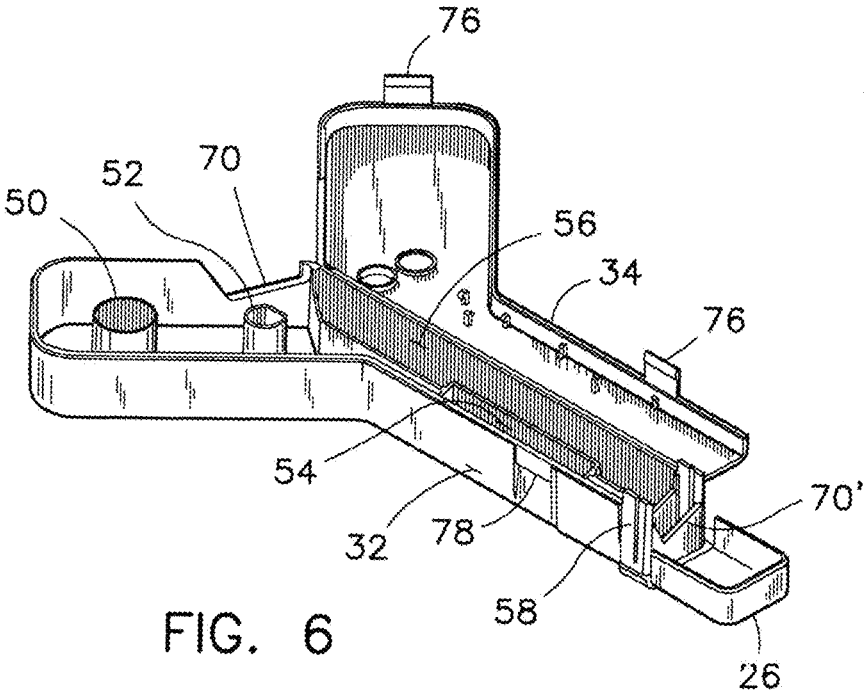
FIG. 6 is a perspective plan, front side and right end view of the preferred hockey tool box.

Referring now to FIGS. 3 to 6, the left end of the bottom half 32 has a notch 70 to receive a hockey stick 72 therein. A similar notch 70' is provided in the miter box 58 as can be seen in FIG. 6. Both notches 70, 70' are aligned with each other and with a longitudinal axis of the miter box 58.

The top half 34 of the casing has a flap 74 to seal the notch 70 when both halves 32, 34 are closed over each other, as can be understood from FIG. 4. Also in FIG. 4 it can be seen that the top half 34 has two latches 76 to engage with a corresponding pair of grooves 78 in the bottom half 32 to secure both halves 32, 34 together when the toolbox 20 is not being used. Hinges 28 and latches 76 can take various forms and are not explained further herein as this is not the focus of the present disclosure.

Referring again particularly to FIG. 3 the elements included in the preferred toolbox 20 are illustrated. Most importantly, the preferred toolbox 20 comprises a handsaw 80, a first roll of tape 82, which has been taken out of its holding boss 52 to make room for a hockey stick 72 in the miter box 58. The toolbox 20 also comprises a second roll of tape 84, a pair of scissor 42 and a marker 46. As mentioned before, at least one block of wax 86 is also included. A second stick 88 of wax or other tape treatment material may be stowed in the center of the large boss 50.

Preferably, the height of the bosses 50 and 52 and the depth of the first half 32 have sufficient dimensions to accommodate at least two rolls of tape on top of each other. The toolbox 20 preferably contains white tape, black tape and a roll of scrim-like grip tape 82.

As mentioned before, a new hockey stick 72 is positioned in the miter box 58, and is supported steady by the spaced-apart notches 70 and 70'. The handsaw 80 is then used to cut the stick 72 along a previously marked line 90 to corresponds to the height, age and position of the player that will be using the new hockey stick.

It will be appreciated that the toolbox 20, the marker 46, the scissors 44 and the handsaw 80, have a portion thereof with a shape representing a hockey stick. These forms contribute to the enforcement of a trademark for the preferred hockey stick toolbox 20.

Referring now to FIGS. 5 and 6, the hockey stick 72 is only partly illustrated, for convenience. In use, the toolbox 20 is opened and laid on a flat surface. The handle of new hockey stick 72 is measured and marked such as at label 90. The handle is positioned in the spaced-apart notches 70, 70', with the marking 90 aligned with the slots of the miter box 58. The handle is then sawed off using the handsaw 80 guided into the slots of the miter box 58.

It will be appreciated that the bottom of each notch 70, 70' has a V-shape, with one side inclined relative to the plan of the open toolbox 20. This inclination supports the handle of the hockey stick 72, with one edge of the handle being first exposed to the handsaw 80. It will be appreciated that a cross-section of the hockey stick handle 72 when steadied in the V-shaped notches 70, 70', form an apex 92 pointing upward, as can be seen in FIG. 5. A cut of the handle is easily started on this apex 92, to facilitate the sawing of the handle. Also, this inclination helps to accommodate and retain hockey stick handles of different cross-section dimensions.

In another feature of the preferred embodiment, the miter box 58 is positioned on the end of the narrow portion 24 of the toolbox 20. This is where a cut is made on the handle of a new hockey stick. This location is believed to be a logical one which makes the preferred embodiment of the present hockey stick toolbox easy to understand without written instruction.

It is believed that the hockey stick toolbox 20 described herein has all the necessary tools needed to personalize a hockey stick in a hurry, in a team dressing room, in a hotel room, or while sitting in the bleachers of an arena.

What is claimed is:

1. A hockey stick toolbox comprising a casing, and a handsaw and a miter box nested in said casing;

said casing having a wide portion and a narrow portion;

said casing having a first V-shaped notch in said wide portion and a second V-shaped notch in said a narrow portion; both said notches being positioned in alignment with each other and said miter box for retaining a hockey stick steady in said miter box;

each of said notches having an inclined side relative to a plan of said casing, for supporting a handle of said hockey stick with a cross-section of said handle forming an apex pointing upward, and said miter box being mounted at an extremity of said narrow portion.

2. The hockey stick toolbox as claimed in, claim 1, further including an assortment of tape and a pair of scissors, nested inside said casing; wherein said assortment of tape comprises two rolls of hockey blade tape of different colours and a roll of scrim tape.

3. The hockey stick toolbox as claimed in claim 2, further comprising a block of hockey tape wax nested in said casing.

4. The hockey stick toolbox as claimed in claim 3, further including a marker nested in said casing.

5. The hockey stick toolbox as claimed in claim 3, wherein said casing further comprises a hinged cap mounted to said narrow portion selectively covering said miter box.

* * * * *